US005939833A

United States Patent [19]

Song et al.

[11] Patent Number: 5,939,833

[45] Date of Patent: Aug. 17, 1999

[54] FIELD EMISSION DEVICE WITH LOW DRIVING VOLTAGE

[75] Inventors: Yoon-Ho Song; Jin-Ho Lee; Kyoung-Ik Cho; Hyung-Joun Yoo, all of Daejeon, Rep. of Korea

[73] Assignee: Electronics and Telecommunications Research Institute, Daejeon, Rep. of Korea

[21] Appl. No.: 08/951,177

[22] Filed: Oct. 15, 1997

[30] Foreign Application Priority Data

Dec. 21, 1996 [KR] Rep. of Korea ..... 96-69791

[51] Int. Cl.[6] ..... G09G 3/10

[52] U.S. Cl. ..... 315/169.1; 345/74; 313/309

[58] Field of Search ..... 315/169.1, 169.3, 315/169.2; 313/309, 336, 351; 345/74, 76

[56] References Cited

U.S. PATENT DOCUMENTS

| | | | |
|---|---|---|---|
| 5,319,233 | 6/1994 | Kane | 257/350 |
| 5,412,285 | 5/1995 | Komatsu | 315/169.1 |
| 5,485,019 | 1/1996 | Yamazaki et al. | 257/57 |
| 5,543,947 | 8/1996 | Mase et al. | 359/84 |
| 5,744,914 | 4/1998 | Konishi | 315/169.1 |

OTHER PUBLICATIONS

Active Control of the Emission Current of Field Emitter Arrays, Kuniuyoshi Yokoo, Manabu Arai, Masahiro Mori, Jongsuck Bae, and Shoichi Ono, Research Institute of Electrical Communication, Tohoku University, Katahira Sendai 980–77, Japan; J. Vac. Sci. Technol. B 12(2), Mar./Apr. 1995, pp. 491–493.

Microtips and Resistive Sheet: A Theoretical Description of the Emissive Properties of this System, 9th International Vacuum Microelectronics Conference, St. Petersburg 1996, R. Baptist, F. Bachelet and C. Constancias, pp. 19–23.

Fabrication of Gated Polycrystalline Silicon Field Emitters, 9th International Vacuum Microelectronics Conference, St. Petersburg 1996, S.E. Hug, M. Huang, P.R. Wilshaw and P.D. Prewett, pp. 367–370.

Amorphous–Silicon–on–Gas Field Emitter Arrays, IEEE Electron Device Letters, vol. 17, N o. 6, Jun. 1996, Hidenori Gamo, Seigo Kanemaru and Junji Itoh, pp. 261–263.

*Primary Examiner*—Haissa Philogene

*Attorney, Agent, or Firm*—Cohen, Pontani, Lieberman & Pavane

[57] ABSTRACT

The present invention relates to a field emission display which applies a field emission device (or field emitter) to a flat panel display. The field emission display in accordance with the present invention has the lower plate in which the pixel array and the scan and data driving circuits are integrated one insulating substrate, therefore, it is possible to implement a field emission display capable of providing a high quality picture in a low price. The voltage is applied to the scan and data driving circuits may considerably decrease through the tin film transistor attached to each pixel. The field emission characteristics are stabilized by the resistor attached to the field emission device so that reliable field emission display may be fabricated. Further, since all the processes are carried out at a low temperature, a glass, which is low in price and has a large area, may be used as an insulating substrate.

7 Claims, 6 Drawing Sheets

FIELD EMISSION DEVICE WITH LOW DRIVING VOLTAGE

BACKGROUND OF THE INVENTION

1. Field of the Invention

The present invention relates to a field emission display which applies a field emission device (or field emitter) to a flat panel display.

2. Description of the Prior Art

In general, the field emission display includes a lower plate having field emitters and an upper plate coated with a fluorescent material such as phosphor. The field emission display indicates a picture on a screen on which the electrons emitted from field emitters, at the lower plate, come into collision with the fluorescent material on the upper plate. This display, which uses a cathode luminescence of the fluorescent material, has been widely developed as a flat panel display which can be substituted for the cathode ray tube (CRT).

FIG. 1 is a schematic view illustrating a configuration of the lower plate in a conventional field emission display. As shown in FIG. 1, a scan wiring 11P and a data wiring 12P are arranged in a matrix type and each pixel consists of a plurality of metal field emitters 21P whose gates are coupled to the scan wiring 11P. The scan wiring 11P is coupled to the output terminal of a scan driving circuit chip 30P through interconnects 13P. The emitter electrode of field emitters 21P is coupled to the data wiring 12P and the data wiring 12P is couple to the output terminal of a data driving circuit chip 40P through interconnects 14P. Furthermore, the scan driving circuit chip 30P and the data driving circuit chip 40P are not integrated together with the pixel array of the field emitter, and are formed on a discrete silicon wafer, being coupled to the pixel array.

On the other hand, FIG. 2 is a cross-sectional view illustrating a conventional metal field emitter 21P in FIG. 1. As shown in FIG. 2, the conventional metal field emitter 21P includes an emitter electrode 215P formed on an insulating substrate 10P, a resist layer 211P, which is made of an amorphous silicon layer, formed on the emitter electrode 215P, a metal field emitter tip 212P formed in a cone type on a portion of the resist layer 211P, and a gate insulating layer 213P and a gate electrode 214P for applying a voltage to the emitter tip 212P.

The conventional field emission display may be easily fabricated on a large glass substrate by using the electron beam evaporation method. However, it is very difficult to integrate the scan and data driving circuits with the metal field emitter array on the insulating substrate. Accordingly, the metal wiring requires a great deal of labor and time in connecting the scan and data driving circuit chips 30P and 40P to the metal field emitter array. Also, since the scan and data driving circuit chips for a high voltage are required to drive the metal field emitter array, it is difficult to implement a field emission display capable of providing a high quality picture in a low price.

SUMMARY OF THE INVENTION

To solve the above problems, an object of the present invention is to provide a field emission display having a high quality picture, a high density and a low driving voltage.

Another object of the present invention is to provide a field emission display in which a pixel array, each pixel consisting of a plurality of silicon field emission devices and one thin film transistor, and scan/data driving circuits are integrated on a single insulating layer.

In accordance with the present invention, there is provided a field emission display including an upper plate and a lower plate parallel to each other, comprising: pixel arrays having a plurality of field emission devices, wherein gate electrodes of said field emission devices are biased to a constant voltage supply; a scan driving circuit and a data driving circuit for driving said pixel array; and a transistor for applying high voltage to said pixel array, having a gate electrode coupled to said scan driving circuit, a source electrode coupled to said data driving circuit and a drain electrode connected to an emitter electrode of one of said field emission devices.

BRIEF DESCRIPTION OF THE DRAWINGS

The present invention may be better understood and its numerous objects and advantages will become apparent to those skilled in the art by reference to the accompanying drawings as follows.

DETAILED DESCRIPTION OF THE PREFERRED EMBODIMENTS

Hereinafter, a field emission display in accordance with the present invention will be described.

A pixel array formed on an insulating layer in a matrix type and scan and data driving circuits for driving the pixel array in the periphery of the pixel array are integrated on a single substrate. Also, each pixel in the pixel array includes a plurality of silicon field emission devices and a high voltage thin-film transistor (HTFT), and the scan and data driving circuits are embodied by complementary polycrystalline silicon TFTs.

The thin film transistor attached with each pixel in the pixel array may be a switching device for controlling a signal applied to the field emission device. Furthermore, according to the field emission display of the present invention, it is possible to lower scan and data signal voltage by addressing signals to be displayed through thin film transistors, and to implement the scan and data driving circuits with a lower signal voltage using a complementary polycrystalline silicon TFT.

Figure 1:
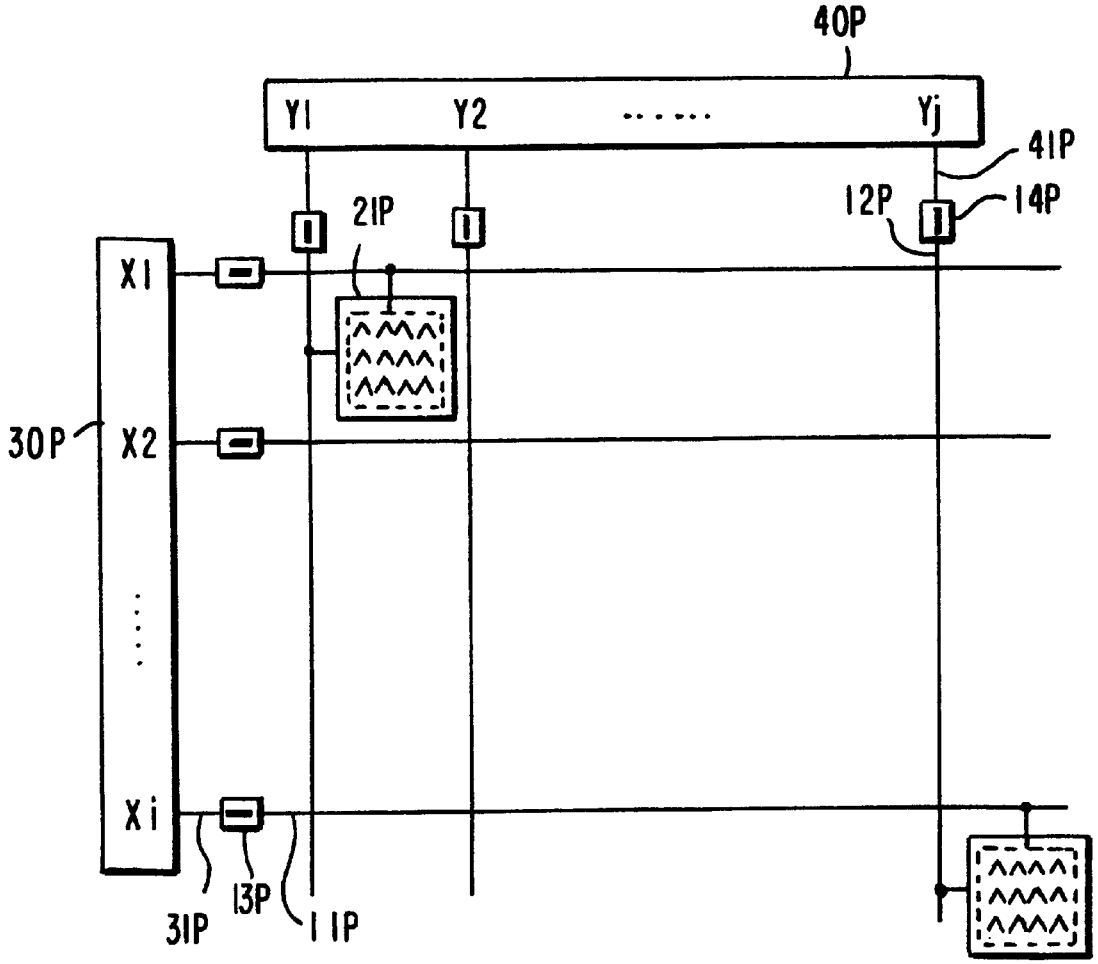
FIG. 1 (PRIOR ART)
FIG. 1 is a schematic view illustrating a configuration of the lower plate in a conventional field emission display.
Figure 2:
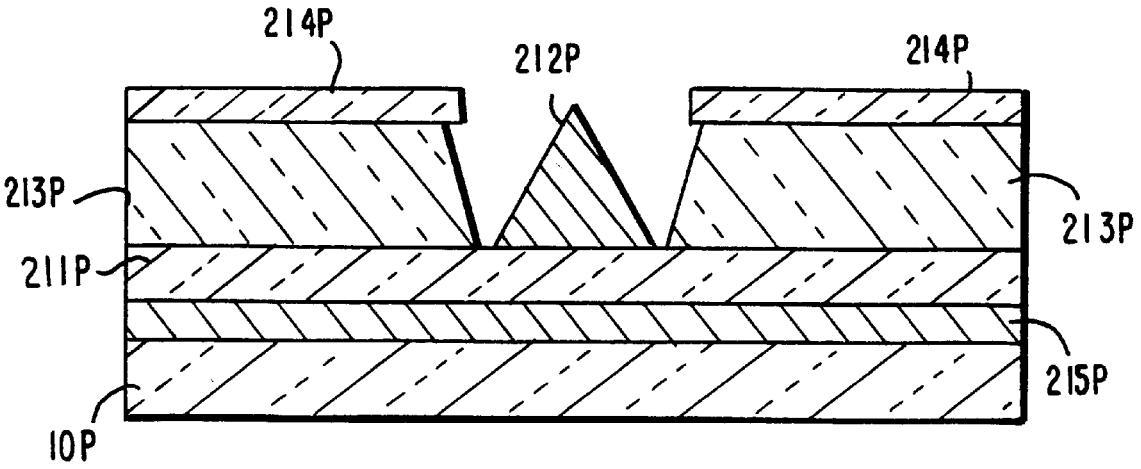
FIG. 2 (PRIOR ART)
FIG. 2 is a cross-sectional view illustrating the metal field emitter 21P in FIG. 1.
Figure 3:
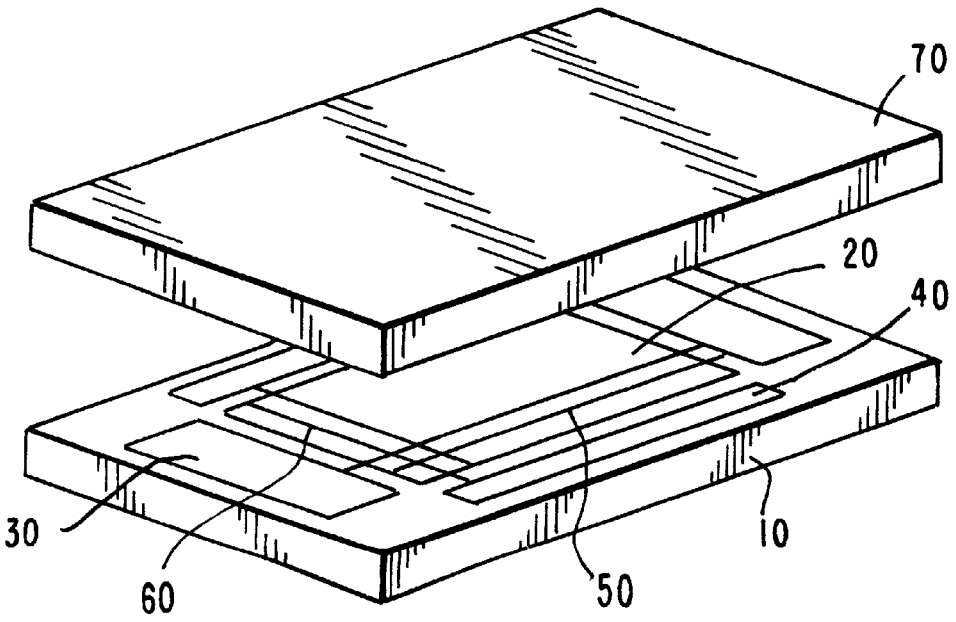
FIG. 3 is a schematic view illustrating a configuration of a field emission display in accordance with the present invention.

FIG. 3 is a schematic view illustrating a configuration of a field emission display in accordance with the present invention. As shown in FIG. 3, the field emission display has an upper plate and a lower plate. The lower plate includes a pixel array 20, which is formed, in a matrix type, on an insulating substrate 10 such as an oxide layer, a nitride layer, a quartz substrate or a glass substrate, and, for driving the pixel array 20, a scan driving circuit 30 and a data driving circuit 40, which are integrated in periphery of the pixel array 20. The reference numeral 50 denotes a scan wiring, 60 a data wiring, 70 a transparent insulating substrate.

First, the lower plate will be described in detailed.

Figure 4:
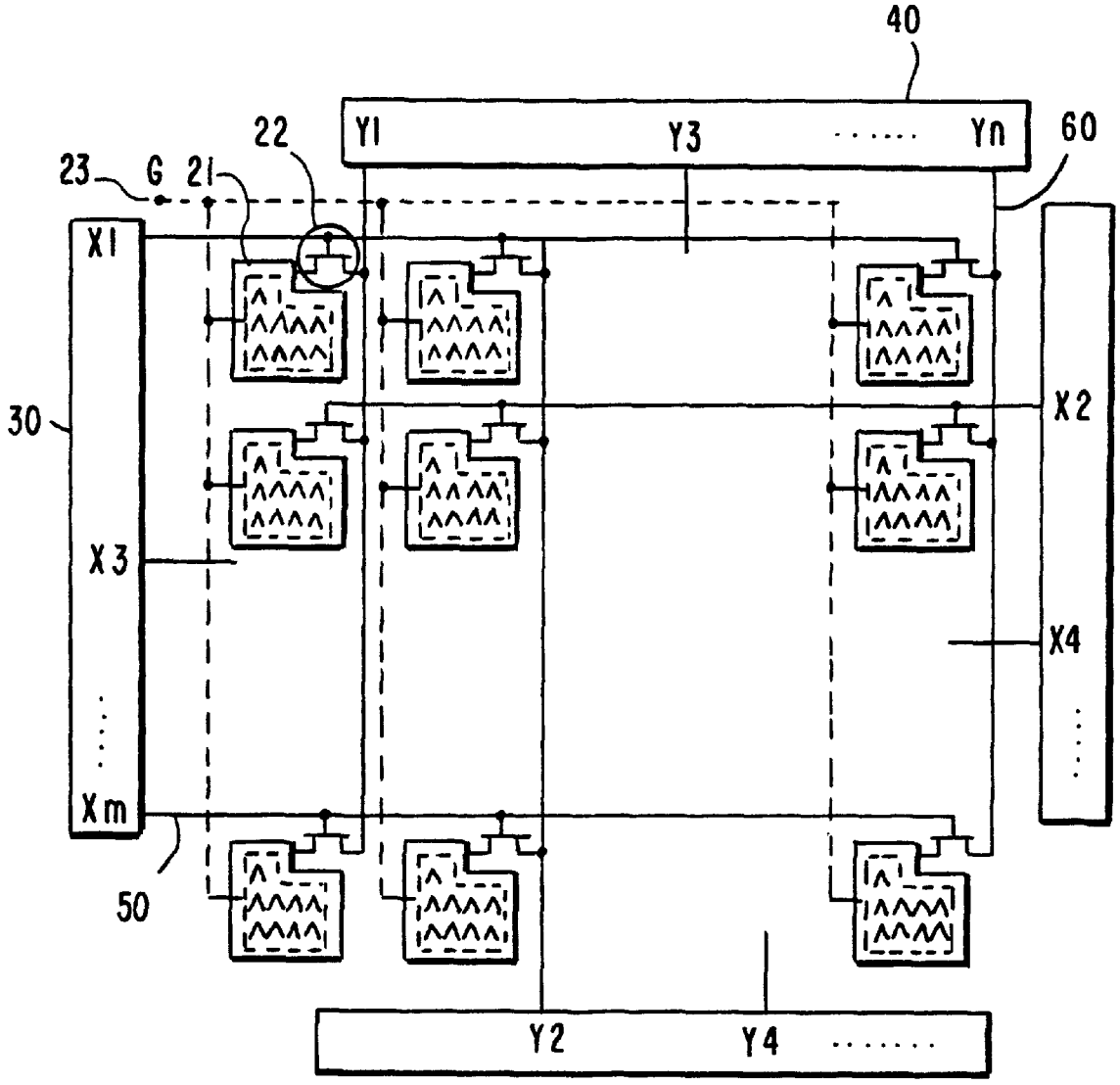
FIG. 4 is a lay out illustrating a pixel array of a field emission display in accordance with the present invention.

FIG. 4 is a lay out illustrating a pixel array of a field emission display in accordance with the present invention. As shown in FIG. 4, the pixel array 20 is formed in a matrix type and each pixel includes a high voltage thin-film transistor 22 and a plurality of silicon field emission devices 21. The silicon field emission devices 21 are connected to one another through an emitter electrode and the high voltage thin-film transistor (HTFT) 22 is composed of an amorphous silicon thin-film transistor or a polycrystalline silicon thin-film transistor. The gates of the HTFTs 22 are coupled to the scan driving circuit 30 by the scan wiring 50. The sources of the HTFTs 22 are coupled to the data driving circuit 40 by the data wiring 60 and the drains thereof are coupled to the emitter electrodes of the field emission devices 21. Also, the gates of the field emission devices 21 are connected to a common gate electrodes 23. The scan driving circuit 30 and the data driving circuit 40 are formed at both sides of the pixel array 20 so that the pixel array is driven with an interlaced driving. However, it would be obvious to one of ordinary skill in the arts to which the subject pertains that this arrangement is not the only means of forming the scan driving circuit 30 and the data driving circuit 40 on the substrate.

Figure 5:
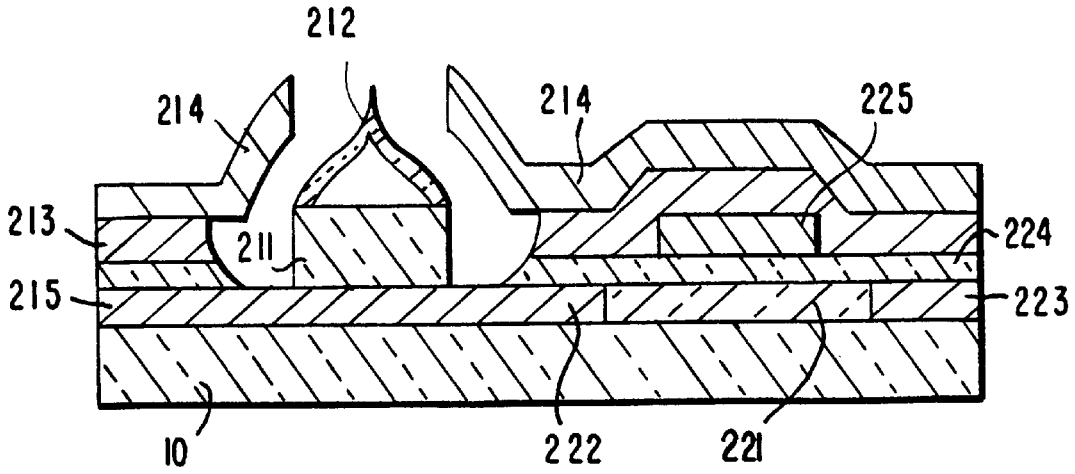
FIG. 5 is a cross-sectional view illustrating a thin film transistor (TFT) for a high voltage and a field emission device for forming a pixel in accordance with the present invention.

FIG. 5 is a cross-sectional view illustrating the HTFT and the field emission device for forming a pixel in accordance with the present invention. As shown in FIG. 5. the silicon field emission device 21 includes an emitter electrode 215 formed on the insulating substrate 10 (the same as that of FIG. 3) such as an oxide layer, a nitride layer, a quartz, a glass, or the like. Also, a cylindrical resist body 211 is formed on the emitter electrode 215 and a silicon field emitter tip 212 is formed in a cone type on the cylindrical resist body 211. The cylindrical resist body 211 and the silicon field emitter tip 212 are surrounded with a gate oxide layer 213 and a gate 214 which are, in order, formed on the emitter electrode 215, in order that an electric field is applied to the silicon field emitter tip 212. At this time, the cylindrical resist body 211 is made of an undoped silicon layer and the entire or a portion of the silicon field emitter tip 212 is made of a doped silicon layer. Since the undoped silicon layer has a high resistivity, the cylindrical resist body itself 211 may serve as a resistor.

On the other hand, the HTFT includes a channel region 221, which is made of an undoped silicon layer formed on the insulating substrate 10, a drain region 222 and a source region 223 which are, respectively, formed at both sides of the channel region 221, a gate insulating layer 224 formed on the channel region 221 and the source/drain regions 223 and 222, and a gate electrode formed on a portion of the gate insulating layer 224. Also, the HTFT has an off-set region in which the gate electrode 225 is not overlapped in a perpendicular direction with the drain region 222 and the source region 223 so that it may be worked at a high voltage. Also, it should be noted that the drain region 222 is electrically connected to the emitter electrode 215 of the field emission device.

Figure 6:
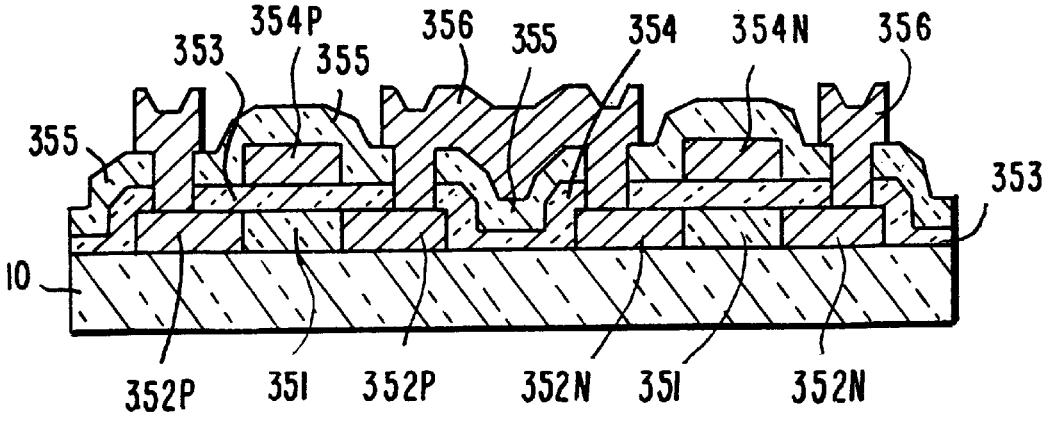
FIG. 6 is a cross-sectional view illustrating a complementary polycrystalline silicon TFT used as a unit circuit of the scan and data driving circuits in accordance with the present invention.

FIG. 6 is a cross-sectional view illustrating a complementary polycrystalline silicon TFT used as a unit circuit of the scan and data driving circuits in accordance with the present invention. The scan and data driving circuits consist of shift registers etc.. Furthermore, the scan and data driving circuits may consist of the complementary polycrystalline silicon TFTs. It is well-known to one of ordinary skill in the arts to which the subject matter pertains. As mentioned above, in the case where the scan and data driving circuits consist of the complementary polycrystalline silicon TFTs, not only may power consumption decrease, but it's operating speed may increase.

Referring to FIG. 6, the complementary polycrystalline silicon TFT according to the present invention includes n-channel and p-channel transistors, each of which is formed on the same insulating substrate 10 as that stated in FIG. 5. Each of them includes a channel region 351, source/drain regions 352N and 352P, a gate insulating layer 353, and impurity-doped gate electrodes 354N and 354P. The channel region 351 is made of an undoped polycrystalline silicon layer formed on the insulating substrate 10 and the source/drain regions 352N and 352P are formed at both sides of the channel region 351. The gate insulating layer 353 is formed on the channel region 351 and the source/drain regions 352N and 352P. The impurity-doped gate electrodes 354N and 354P is formed a portion of the gate insulating layer 353. An interlayer insulating layer 355 is formed on the resulting structure and openings are formed, thereby exposing the source/drain regions 352N and 352P. A metal interconnection is formed and then the drain region 352N of N-channel transistor is electrically connected to the source region 352P of N-channel transistor. It should be noted that the channel 351 of the complementary polycrystalline silicon TFT is made of the same polycrystalline silicon layer on the channel 221 of the HTFT in FIG. 5.

Figure 7:
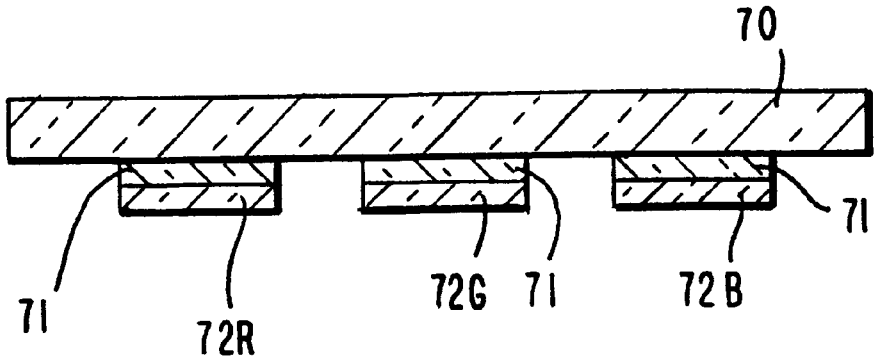
FIG. 7 is a cross-sectional view illustrating a configuration of the upper plate of the field emission display in accordance with the present invention.

FIG. 7 is a cross-sectional view illustrating a configuration of the upper plate of the field emission display in accordance with the present invention. As shown in FIG. 7, a transparent electrode 71 is formed on a portion of an insulating transparent substrate 70, and, fluorescent layers 72R, 72G and 72B are respectively formed on the transparent electrode 71 to bring out the color. The transparent electrode 71 is coupled to an anode driving circuit and the fluorescent material 72R, 72G and 72B make a color pixel.

The field emission display panel get accomplished by applying the vacuum packaging to the upper and lower plate in parallel. The scan, data, and anode driving circuits in the field emission display panel are controlled by a display control circuit.

Next, a method for fabricating the field emission display of the present invention will be described below.

According to the present invention, the high voltage thin-film transistor 22, which is coupled to the silicon field emission device 21, is embodied with a n-channel transistor, and the surface of the field emitter tip 212 is made of n-type polycrystalline silicon. Therefore, the silicon field emission device 21 and the high voltage thin-film transistor 22 are integrated with facility, by using a conventional method for forming a silicon field emission device by an etching process and a thin film transistor fabrication process. Furthermore, when the thin film transistor 22 is fabricated, the complementary polycrystalline silicon TFT used as a unit circuit of the scan and data driving circuits 30 and 40 is easily fabricated by once again applying the ion implantation or ion shower process of p-type dopants to the source/drain region. Accordingly, it is possible to easily integrate the pixel array 20 and the scan and data driving circuits 30 and 40 on one substrate.

Since the above-mentioned processes are carried out at a temperature of 600° C. or less, a glass, which is low in price and has a large area, may be used as an insulating substrate.

Figure 8:
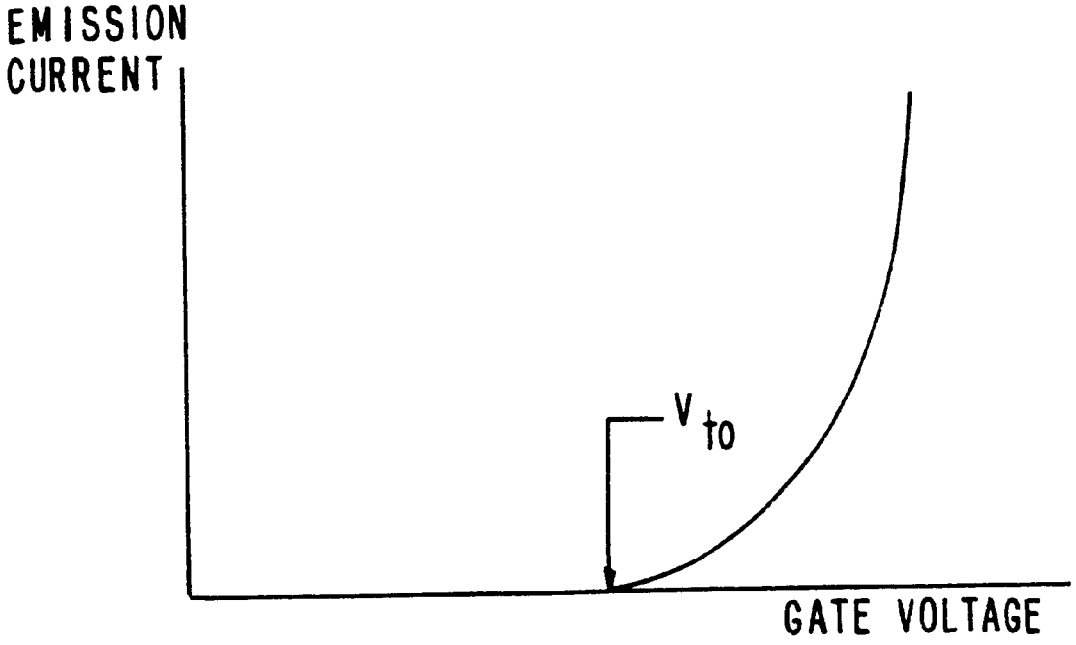
FIG. 8 is a plot illustrating the current-voltage characteristics of the field emission devices in accordance with the present invention.

FIG. 8 is a plot illustrating the current-voltage characteristics of the field emission device in accordance with the present invention. The gate voltage denotes the voltage applied to the gate electrode of the field emission device 214. If a specific voltage, which is higher than the turn-on voltage (typically, 50 voltage or more), is applied to the gate electrode, electrons are emitted from the emitter tip 212 of the field emission device.

Figure 9:
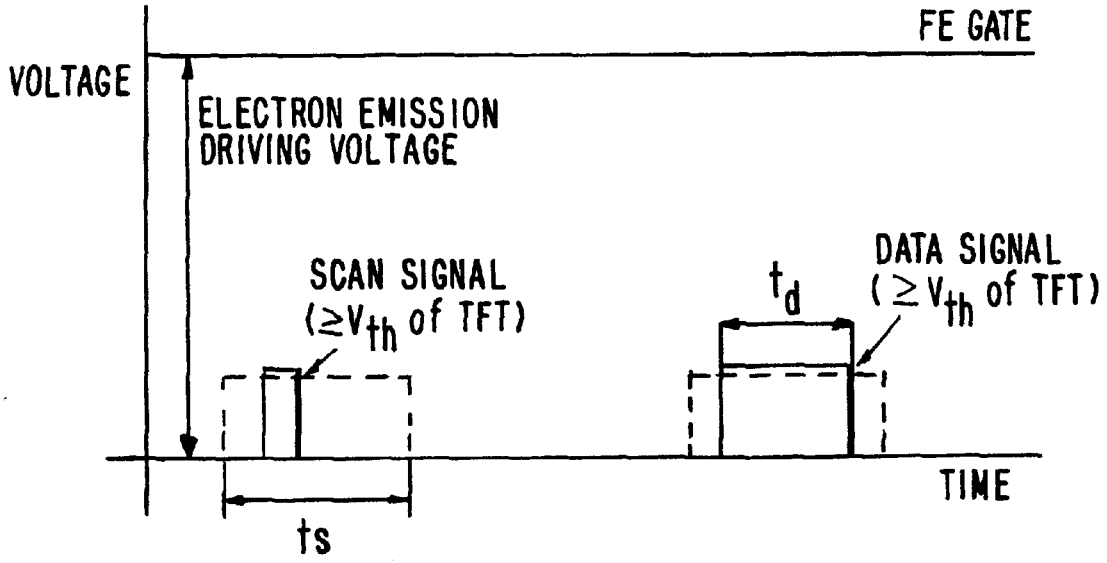
FIG. 9 is a timing chart illustrating the signal voltages for operating the field emission display in accordance with the present invention.

FIG. 9 is a timing chart illustrating the signal voltage characteristics in accordance with the present invention, in which there are shown voltage signals to drive the field emission display. As shown in FIG. 9, the FE gate, which is a voltage applied to the common gate electrodes 23 of the field emitter device 21, is maintained at a constant voltage. The scan signal, which is a voltage applied to the gate electrode 225 of the n-channel thin film transistor 22 through the scan wiring 50 from the scan driving circuit 30, may be one of a threshold voltage of the n-type thin film transistor or more than that thereof. This scan signal selects one line of the pixel array in a pulse signal type (pulse width:$t_s$).

Also, the data signal, which is a voltage applied to the source 225 of the n-channel thin film transistor 22 through the data wiring 60 from the data driving circuit 40, is transferred to the emitter tip 212 of the field emission device 21 in a pulse signal type (pulse width:$t_d$) , and then induces the electrons' emission when the scan signal is in an on-state. Accordingly, the effective time for electron emission is ($t_s$–$t_d$) when a pixel line is selected by the scan signal.

In this driving method, the gray level representation of the display is performed by changing the pulse width of the data signal $t_d$. The voltage of the scan and data signals may considerably decrease by controlling the line selection and the data signal of the display using the high voltage thin-film transistor 22 attached to each pixel.

As apparent from the above, the field emission display in accordance with the present invention has the lower plate in which the pixel array and the scan and data driving circuits are integrated one insulating substrate, therefore, it is possible to implement a field emission display capable of providing a high quality picture in a low price. The signal voltage of the scan and data driving circuits may considerably decrease using the thin film transistor attached to each pixel. The field emission characteristics are stabilized by the resistor attached to the field emission device so that reliable field emission display may be fabricated. Further, since all the processes are carried out at a low temperature, a glass, which is low in price and has a large area, may be used as an insulating substrate.

Although the preferred embodiment of the present invention has been disclosed for illustrative purpose, those skilled in the art will appreciate that various modifications, additions and substitutions are possible, without departing from the scope and spirit of the invention as disclosed in the accompanying claims.

What is claimed is:

1. A field emission display including an upper plate and a lower plate arranged parallel to each other, comprising:

a pixel array having a plurality of field emission devices, wherein each one of said plurality of field emission devices comprises a gate electrode biased to a constant voltage supply;

a scan driving circuit and a data driving circuit operatively connected to said each one of said plurality of field emission devices for driving said pixel array; and a plurality of thin film transistors for applying high voltage to said each one of said plurality of field emission devices of said pixel array, respectively, each one of said plurality of thin film transistors having a gate electrode coupled to said scan driving circuit, a source electrode coupled to said data driving circuit and a drain electrode connected to an emitter electrode of said each one of said field emission devices, said lower plate having a substrate, wherein said pixel array, said scan driving circuit, said data driving circuit and said plurality of thin film transistors are integrated on said substrate of said lower plate.

2. A field emission display in accordance with claim 1, wherein said substrate comprises one of an oxide layer, a nitride layer, a quartz substrate and a glass substrate.

3. A field emission display in accordance with claim 1, wherein said scan driving circuit and said data driving circuit comprise complementary polycrystalline silicon TFTs.

4. A field emission display in accordance with claim 3, wherein each one of said thin film transistors comprises a channel formed on a same film as said complementary polycrystalline silicon TFTs.

5. A field emission display in accordance with claim 1, wherein said each one of said plurality of field emission devices comprises:

a cylindrical resist body formed on said emitter electrode;

a cone-shaped silicon field emitter tip formed on said cylindrical resist body; and a gate electrode and a gate oxide layer surrounding said silicon field emitter tip operatively positioned for applying an electric field to said silicon field emitter tip.

6. A field emission display in accordance with claim 5, wherein said cylindrical resist body comprises an undoped silicon layer.

7. A field emission display in accordance with claim 5, wherein said silicon field emitter tip comprises a doped silicon layer.

* * * * *